US007226084B2

(12) United States Patent
Lenhart

(10) Patent No.: US 7,226,084 B2
(45) Date of Patent: Jun. 5, 2007

(54) STICK HANDLE WITH A TOGGLE STRAP

(76) Inventor: Klaus Lenhart, Mittlerer Weg 23, 73275 Ohmden (DE)

( * ) Notice: Subject to any disclaimer, the term of this patent is extended or adjusted under 35 U.S.C. 154(b) by 192 days.

(21) Appl. No.: 10/520,428

(22) PCT Filed: Sep. 12, 2003

(86) PCT No.: PCT/EP03/10157

§ 371 (c)(1),
(2), (4) Date: Jan. 6, 2005

(87) PCT Pub. No.: WO2004/052476

PCT Pub. Date: Jun. 24, 2004

(65) Prior Publication Data

US 2005/0225070 A1 Oct. 13, 2005

(30) Foreign Application Priority Data

Dec. 10, 2002 (DE) ..... 202 19 461 U

(51) Int. Cl.
*A63C 11/00* (2006.01)
*A63C 11/22* (2006.01)
*A63C 11/24* (2006.01)
*A63C 17/28* (2006.01)

(52) U.S. Cl. ..... 280/822; 280/819; 280/821; 280/824; 280/826

(58) Field of Classification Search ..... 280/819, 280/821, 822, 824, 826
See application file for complete search history.

(56) References Cited

U.S. PATENT DOCUMENTS 3,582,100 A * 6/1971 Allsop ..... 280/821
5,549,330 A * 8/1996 Wells ..... 280/822
6,325,418 B1 * 12/2001 Lenhart ..... 280/821
6,491,323 B1 * 12/2002 Kustritz ..... 280/821

FOREIGN PATENT DOCUMENTS

| | | |
|---|---|---|
| DE | 196 36 852 | 2/1998 |
| DE | 299 04 591 U1 | 9/2000 |
| EP | 1 036 579 | 9/2000 |
| FI | 109 524 | 8/2002 |
| FR | 2 668 378 | 4/1992 |
| WO | WO 03/022377 | 3/2003 |

* cited by examiner

*Primary Examiner*—Christopher P. Ellis
*Assistant Examiner*—John R. Olszewski
(74) *Attorney, Agent, or Firm*—Sughrue Mion, PLLC

(57) ABSTRACT

A pole handle (10) provided with a hand retaining device (11) in the form of a toggle strap or a glove which can become detachably engaged with the pole handle (10) by means of a connecting element (64) disposed on the hand retaining device (11). A second connecting element (46) which cooperates with the first connecting element (64) is provided in a recess (26) of the pole handle and can be moved by means of an actuating member (41), which is accessible in the handle head region. In order to ensure a simpler and more ergonomic detachable fixing of the hand retaining device, access to the pole handle recess (26) is provided by means of a longitudinal slit (31) which extends from above to below the area of movement of the second connecting element (46), and parallel or inclined in relation to the longitudinal pole handle axis (17).

17 Claims, 2 Drawing Sheets

STICK HANDLE WITH A TOGGLE STRAP

This application is the national stage of PCT/EP2003/010157 filed on Sep. 12, 2003 and also claims Paris Convention priority of DE 202 19 461.2 filed on Dec. 10, 2002.

BACKGROUND OF THE INVENTION

The present invention concerns a pole handle, in particular for cross-country ski poles, nordic walking and alpine poles, comprising a hand retaining device, in accordance with the independent claim, and a ski pole comprising such a pole handle.

In the pole handle disclosed in DE 299 04 591 U1, the pole handle recess extends between an access for the first connecting element of a toggle strap and an opposite outlet opening for the actuating member in an acute-angle arrangement with respect to the longitudinal axis of the pole handle or ski pole. This means that the connecting element fixed on the toggle strap is locked from an inclined direction from below the upper pole handle end and exits in an opposite inclined downward direction. The actuating member and the second connecting member are formed in one piece and are designed as a one-armed lever. Since the pivot axis is disposed at the end of the second connecting member, locking requires great force and is difficult since the locking region is very close to the pivot axis. Moreover, the direction of locking of the first connecting element on the toggle strap to move behind the second connecting element on the one-armed actuating lever requires a movement which is not ergonomic and is extremely difficult to carry out using one hand only.

It is the object of the present invention to design a pole handle of the above-mentioned type which can be detachably mounted to the hand retaining device in a simpler and, in particular with regard to locking, more ergonomic manner.

SUMMARY OF THE INVENTION

This object is achieved with a pole handle of the above-mentioned type having the features of the independent claim.

In accordance with the invention, a simple and substantially linear motion in the direction of the longitudinal axis of the pole handle or of the ski pole is sufficient to lock the hand retaining device via its first connecting element thereby simultaneously utilizing counter pressure for the locking process generated by the ski pole itself via its support on the ground. This facilitates and accelerates at least the connecting motion without requiring assistance by the respective other hand.

To insert the first connecting element of the hand retaining device into the longitudinal slit on the pole handle, the latter could have a radial insertion opening in its upper region such that the initial mounting motion is radial and is then followed by an axial motion. However, in the preferred embodiment in which the longitudinal slit, which extends in the first wall delimiting the pole handle recess, can be accessed in a region of the handle head front face, the connecting motion consists exclusively of a substantially axial motion of the first connecting element and of the toggle strap, as the first connecting element is introduced into the longitudinal slit from the upper side of the handle head.

Preferred embodiments of the first connecting element of the toggle strap and its guidance in the longitudinal slit are shown by the features of one or more of the dependent claims.

Preferred constructive embodiments of the actuating member or advantageous handling to release the locking can be extracted from the features of one or more of dependent claims. The actuating lever is thereby disposed to prevent inadvertent actuation thereof while still permitting operation using one hand only for locking and releasing the first connecting element to and from the hand retaining device.

The invention also concerns a ski pole comprising a pole handle in accordance with the features of the independent claim and optionally with at least any one of the dependent claims.

Further details of the invention can be extracted from the following description which describes and explains the invention in more detail using the embodiment shown in the drawing.

DESCRIPTION OF THE PREFERRED EMBODIMENT

Figure 1:
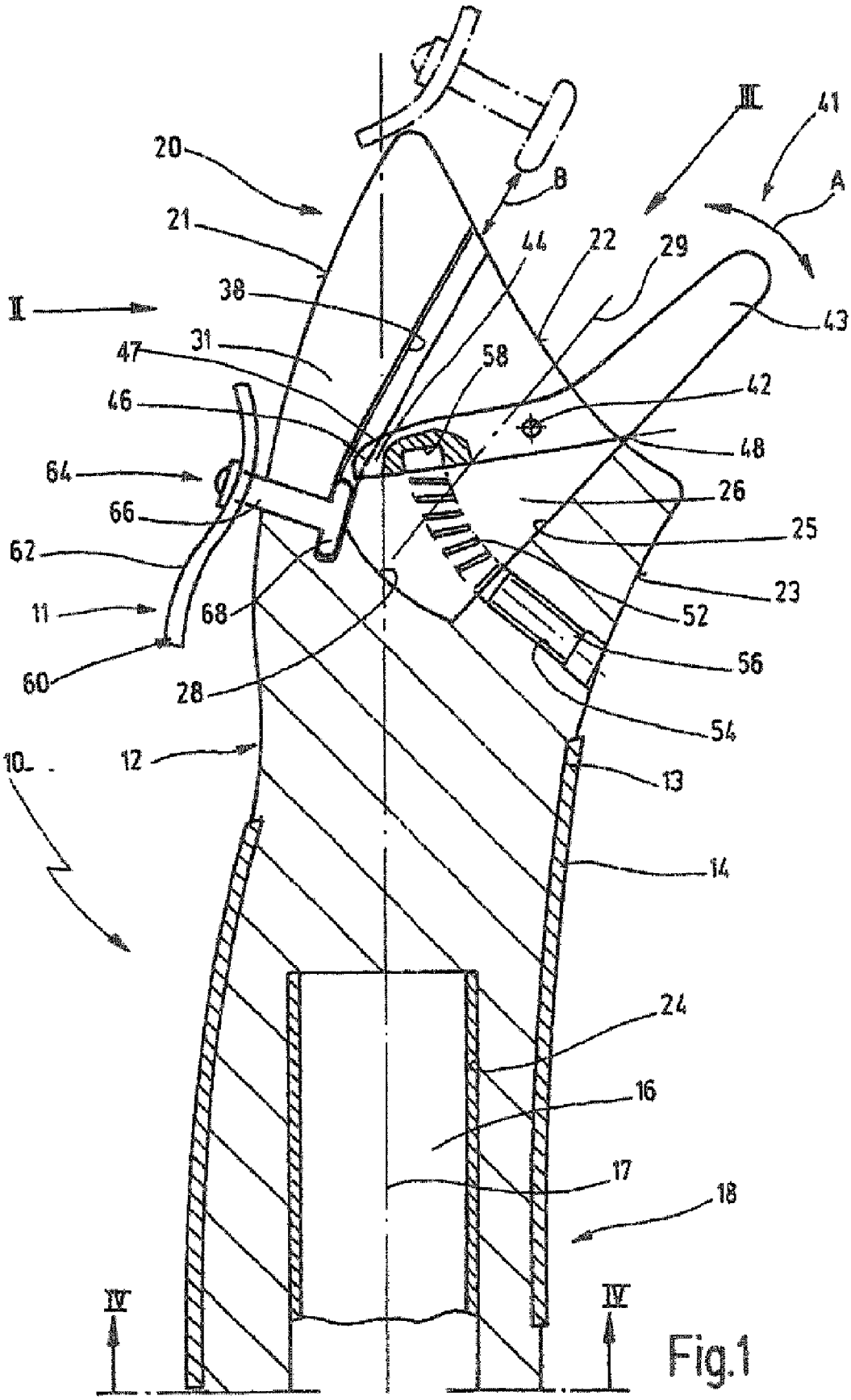
FIG. 1 shows a longitudinal section, which is partially broken away, of a pole handle with detachably lockable hand retaining device in accordance with a preferred embodiment of the present invention.
Figure 2:
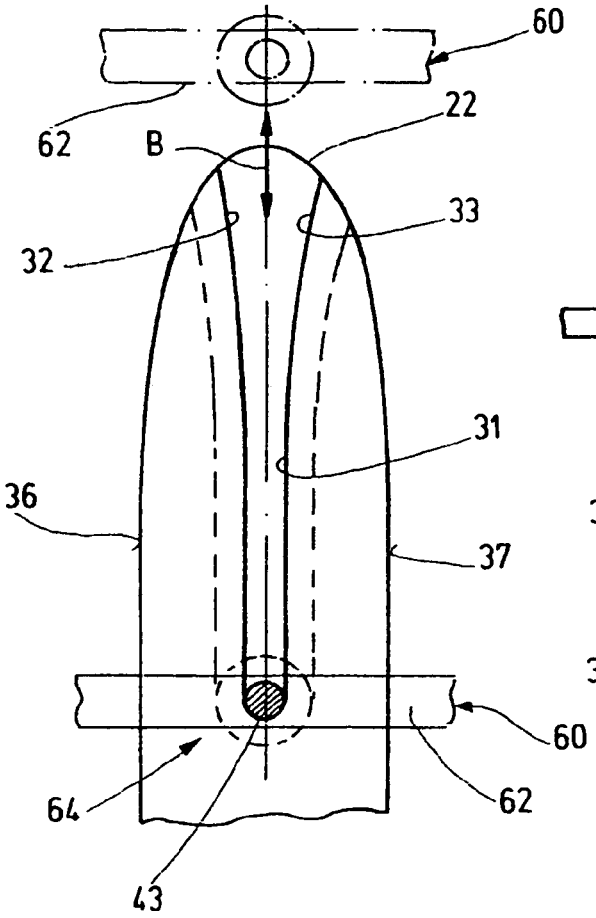
FIG. 2 shows a partially broken away view in accordance with arrow II of FIG. 1.

The pole handle 10 shown in the drawing in accordance with a preferred embodiment comprises a basic body 12 which is produced e.g. from an injection-molded part of plastic material. The direct handle region of the basic body 12 is provided with a coating 14 of easy-to-grip material which is introduced into a peripheral groove 13 in the basic body 12 (shown in the drawing). The pole handle 10 is attached onto and over a pole tube 16 of a cross-country ski, alpine or nordic walking pole and is rigidly connected thereto (preferably glued or pressed).

Figure 3:
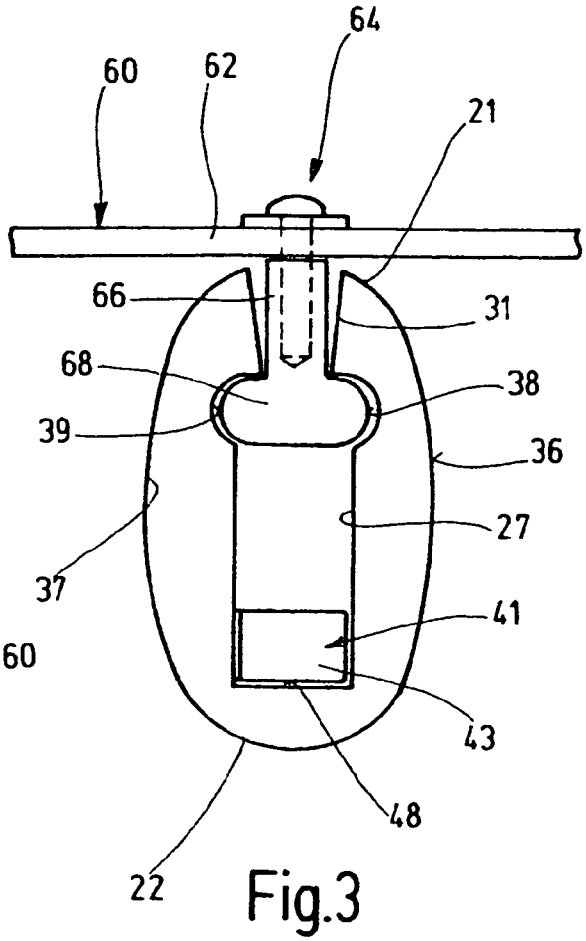
FIG. 3 shows a view in accordance with arrow III of FIG. 1.
Figure 4:
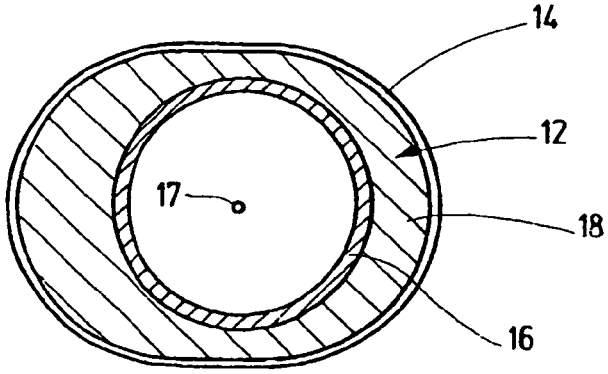
FIG. 4 shows a section along the line IV—IV of FIG. 1.

The basic body 12 of the pole handle 10 is approximately oval in a lower region 18 and is disposed eccentrically with regard to the longitudinal axis 17 of the pole tube 16 (see FIG. 4). The upper end region 20 of the basic body 12 of the pole handle 10 has a flat oval shape (shown in FIG. 3). The upper end region 20 is laterally inclined with respect to the longitudinal axis 17 (FIG. 1), wherein the narrow sides 21 and 23 of the oval shape are slightly curved. The upper end region 20 of the basic body 12 has a front head face 22 which is flat in the direction of its narrow dimensions and is slightly concave in its longitudinal dimension and which extends at an inclined, acute angle with respect to the longitudinal axis 17. In addition to the axial cylindrical cavity 24 in the lower end region 18 for receiving the end of the pole tube 16, the basic body 12 has a recess 26 in its upper end region 20 at a certain distance above this cylindrical cavity 24, which is substantially rectangular and has a substantially uniform cross-section. The recess 26 can be accessed by an opening 27 in the handle head front face 22. The bottom 28 of the recess 26 is closed. The longitudinal axis 29 of the recess 26 extends at an acute angle with respect to the longitudinal axis 17 of the pole handle 10 or pole tube 16 and approximately perpendicular to the handle head front face 22. The front narrow side 21 of the basic body 12 has a longitudinal slit 31 which can be accessed from the handle head front face 22 and is provided at that location with inclined insertion surfaces 32, 33. The bottom 43 of the longitudinal slit 31 is disposed slightly above the bottom 28 of the recess 26 and terminates before the coating 14. Grooves 38 and 39 which have a concave bottom and extend over the length of the longitudinal slit 31 are provided within the recess 26, facing the longitudinal slit 31, in the two side surfaces 36 and 37 and extend parallel to each other to delimit the recess 26.

A two-armed lever 41 is pivotably held within the recess 26 via a pivot axle 42 such that it is parallel to the side surfaces 36, 37 of the basic body 12. The pivot axis 42 traverses the recess 26 in an upper rear region and is disposed or held in bores of the two side surfaces 36 and 37. The two-armed lever has an actuating arm 43 which projects outwardly through the opening 27 in the handle head front face 22. A locking arm 44 of the two-armed lever 41 is integral with the actuating arm 43 with the two arms 43 and 44 subtending an obtuse angle. The pivot axle 42 penetrates through the two-armed lever 41 in a region of the locking arm 44 proximate to the actuating arm 43. The locking arm 44 has a connecting element 46 in the form of a nose which terminates close to the front narrow side 21 of the basic body 12 having the longitudinal slit 31 and is provided with an inclined guiding surface 47 at its side facing away from the bottom 28 of the recess 26.

The two-armed lever 41 is loaded by a pressure spring 52 which is designed as a helical spring in the present case and one end of which is supported on the locking arm 44 of the lever 41 within the recess 26 and whose other end is immersed into a bore 54 which extends from the rear narrow side 23 to the inner recess delimitation 25 and is supported on a stop which is formed by a screw 56 inserted from the outside into the rear narrow side 23 of the basic body 12. The pressure spring 52 which extends in a slightly curved manner and is immersed in a blind bore 58 in the locking arm 44 pretensions the two-armed lever 41 into a rest position in which the actuating arm 43 abuts an edge region 48 of the recess 27. The connecting element 46 of the locking arm 44 is thereby proximate to the longitudinal slit 31 in the front narrow side 21. In accordance with arrow A, the two-armed lever 41 can be pivoted about the pivot axle 42, wherein the pivot delimitation is determined on the one hand by the edge region 48 of the recess 26 and on the other hand by the spring path of the pressure spring 52.

In accordance with one embodiment (not shown), the pressure spring 52 is designed as an approximately V-shaped leaf spring whose legs are supported on the inner side on a locking arm 44 and on the opposite side surface 25 of the recess 26 and whose apex faces the edge region 48 of the recess 26.

A toggle strap 11 or another holding device for the hand of a skier, such as e.g. a glove, can be detachably locked to the pole handle 10 (wherein FIG. 1 only shows the mounting section 62 of a strap 60). A connecting element 64 which has the approximate shape of a mushroom and which is made from a suitable plastic material or metal is mounted, e.g. screwed to the strap 60. The connecting element 64 has a shaft 66 which is connected to the strap 60 and whose width or diameter is slightly smaller than the width of the longitudinal slit 31 in the basic body 12. The length of the shaft 66, which is cylindrical in the present case, corresponds approximately to the depth of the longitudinal slit 31 or the separation between the outer side of the front narrow side 21 and the inner grooves 38 and 39. The shaft 66 is integral with the head 68 which is substantially wider than the shaft 66 and whose peripheral edge has a shape corresponding approximately to the shape of the two grooves 38 and 39, in which the head 68 is guided. The outer cross-sectional dimensions of the connecting element 64 are such that it can be introduced, together with the strap 60 of the toggle strap 11 with hardly any play, from the handle head front face 22, into the longitudinal slit 31 and be removed therefrom as shown by the double arrow B and the positions of FIG. 1 shown in solid and dash-dotted lines.

The connecting element or nose 46 of the locking arm 44 is a counter locking element and serves to lock the connecting element 64 behind the locking arm 44 of the two-armed lever 41. When the connecting element 64 held by the hand strap is introduced into the longitudinal slit 31 from the position in FIG. 1 shown with dash-dotted lines, the shaft 66 in the longitudinal slit 31 and the head 68 in the two side grooves 38 and 39 slide downwardly and press the locking arm 44 inwardly via the inclined guiding surface 47 in opposition to the action of the pressure spring 52. After the head 68 of the locking element 64 has passed by the connecting element 46 of the locking arm 44, the locking arm 44 returns to its initial position under the action of the pressure spring 52. The head 68 of the connecting element 64 is thereby caught between the lower side of the nose 46 of the locking arm 44 and the bottom 34 of the longitudinal slit 31. Release of the connecting element 64 or of the toggle strap 11 from the basic body 12 of the pole handle 10 and thereby release of the locking is effected in a corresponding reverse manner through pivoting the two-armed lever 41 using the actuating arm 43 from its rest position shown in fully drawn lines into a release position (not shown) in opposition to the force of the pressure spring 52. The head 68 of the connecting element 64 is thereby released from behind the locking arm 44 and its connecting element 46 and can be removed from the longitudinal slit 31. The motion releasing locking of the lever 41 can be easily performed e.g. by the index finger of the hand while the pole handle 10 is being grasped.

I claim:

1. A pole handle comprising:

a hand retaining device;

a first connecting element integral with said hand retaining device for detachably locking said hand retaining device to the pole handle;

means defining a pole handle recess, said recess defining means having a first wall facing said hand retaining device, said first wall having a longitudinal slit providing access to said pole handle recess for insertion and removal of said first connecting element, said longitudinal slit extending parallel to or at an angle with respect to a longitudinal pole axis and being accessible in a region of a handle head front face, said first connecting element being lockable in said longitudinal slit by a downward motion;

a second connecting element disposed in said pole handle recess to cooperate with said first connecting element;

an actuating member communicating with said second connecting element, said actuating member structured and dimensioned for access in a region of a pole handle head; and a resilient bearing cooperating with said actuating member to oppose second connecting element motion caused by said actuating member, wherein said longitudinal slit extends from above to below a range of motion of said second connecting element.

2. The pole handle of claim 1, wherein said pole handle is structured and dimensioned for cross-country skiing, alpine skiing or nordic walking.

3. The pole handle of claim 1, wherein said hand retaining device comprises a toggle strap or a glove.

4. The pole handle of claim 1, wherein said first connecting element comprises a mushroom-like or other undercut shape for axial guidance and radial holding in said longitudinal slit.

5. The pole handle of claim 4, wherein said first wall has opposite grooves which guide said first connecting element.

6. The pole handle of claim 1, wherein an end of said longitudinal slit defines a stop for said first connecting element during insertion into said pole handle recess.

7. The pole handle of claim 1, wherein a handle head front face of the pole handle defines a longitudinal opening through which said actuating member projects.

8. The pole handle of claim 7, wherein said front face is bevelled.

9. The pole handle of claim 1, wherein said actuating member comprises a first lever which is pivotably disposed in said pole handle recess.

10. The pole handle of claim 9, wherein said first lever is integral with said second connecting element to define a two-armed lever.

11. The pole handle of claim 10, wherein said two-armed lever is hinged to a pivot axle which is disposed proximate to said first lever.

12. The pole handle of claim 11, wherein said resilient bearing comprises a spring element which loads said two-armed lever between said pivot axle and said second connecting element.

13. The pole handle of claim 12, wherein said spring element comprises a pressure spring or another spring element supported on an inner wall region of said recess to push said actuating arm against a wall region of the pole handle delimiting said pole handle recess to urge said second connecting element into a path of said first connecting element.

14. A cross-country ski pole, alpine ski pole, or nordic walking pole comprising the pole handle of claim 1.

15. A pole handle comprising:

a hand retaining device;

a first connecting element integral with said hand retaining device for detachably locking said hand retaining device to the pole handle;

means defining a pole handle recess, said recess defining means having a first wall facing said hand retaining device, said first wall having a longitudinal slit providing access to said pole handle recess for insertion and removal of said first connecting element, said longitudinal slit extending parallel to or at an angle with respect to a longitudinal pole axis, said first connecting element comprising a mushroom-like or other undercut shape or axial guidance and radial holding in said longitudinal slit and being lockable in said longitudinal slit by downward motion, a second connecting element disposed in said pole handle recess to cooperate with said first connecting element;

an actuating member communicating with said second connecting element, said actuating member structured and dimensioned for access in a region of a pole handle head; and a resilient bearing cooperating with said actuating member to oppose second connecting element motion caused by said actuating member, wherein said longitudinal slit extends from above to below a range of motion of said second connecting element.

16. A pole handle comprising:

a hand retaining device;

a first connecting element integral with said hand retaining device for detachably locking said hand retaining device to the pole handle, said first connecting element being insertable exclusively by a substantially axial motion;

means defining a pole handle recess, said recess defining means having a first wall facing said hand retaining device, said first wall having a longitudinal slit providing access to said pole handle recess for insertion and removal of said first connecting element, said longitudinal slit extending parallel to or at an angle with respect to a longitudinal pole axis;

a second connecting element disposed in said pole handle recess to cooperate with said first connecting element;

an actuating member communicating with said second connecting element, said actuating member structured and dimensioned for access in a region of a pole handle head; and a resilient bearing cooperating with said actuating member to oppose second connecting element motion caused by said actuating member, wherein said longitudinal slit extends from above to below a range of motion of said second connecting element.

17. The pole handle of claim 16, wherein said first connecting element is self-engageable.

* * * * *